United States Patent [19]

Bodine

[11] 4,280,558

[45] Jul. 28, 1981

[54] SONIC TECHNIQUE AND SYSTEM FOR FACILITATING THE EXTRACTION OF MINERAL MATERIAL

[76] Inventor: Albert G. Bodine, 7877 Woodley Ave., Van Nuys, Calif. 91406

[21] Appl. No.: 96,755

[22] Filed: Nov. 23, 1979

[51] Int. Cl.[3] ..... E21B 43/25; E21B 43/30

[52] U.S. Cl. ..... 166/245; 166/177; 166/249

[58] Field of Search ..... 166/245, 249, 268, 177; 299/4, 14; 175/56

[56] References Cited

U.S. PATENT DOCUMENTS

| | | | |
|---|---|---|---|
| 2,670,801 | 3/1954 | Sherborne | 166/249 |
| 2,796,129 | 6/1957 | Brandon | 166/249 |
| 3,220,476 | 11/1965 | Brandon | 166/249 |
| 3,302,720 | 2/1967 | Brandon | 166/249 |
| 3,509,948 | 5/1970 | Besnard | 175/56 X |
| 3,624,760 | 11/1971 | Bodine | 175/56 |
| 3,645,345 | 2/1972 | Olsen et al. | 175/56 |
| 3,684,037 | 8/1972 | Bodine | 175/56 |
| 4,144,935 | 3/1979 | Bridges et al. | 166/245 X |

FOREIGN PATENT DOCUMENTS

| | | | |
|---|---|---|---|
| 325353 | 3/1972 | U.S.S.R. | 299/4 |

*Primary Examiner*—James A. Leppink
*Assistant Examiner*—George A. Suchfield
*Attorney, Agent, or Firm*—Edward A. Sokolski

[57] ABSTRACT

A first casing is sonically driven into an earthen formation bearing a mineral such as oil. A second casing is similarly sonically driven into the same zone of the formation at a location spaced from the first casing. Water is pumped from the first casing into the formation. A series of piling members which may be in the form of sheets or may be tubular in shape are sonically driven into the formation at predetermined spaced positions between the two casings and with a predetermined orientation relative thereto. Sonic energy is simultaneously applied to the casings and piling members so as to cause resonant standing wave vibrations thereof while water is pumped through the first mentioned casing into the formation while mineral and water effluent are pumped out of the second casing. The sonic energy operates to loosen the mineral from the sand such that the pressurized water can effectively drive the oil to the second casing. After most of the mineral oil has been extracted out of the first area defined by the pilings, they may be removed from the group and reinstalled in different locations. and with a different orientation, this process being continued at various locations and orientations for the pilings between the two casings until all the usable mineral has been extracted from the vicinity of the two casings.

12 Claims, 4 Drawing Figures

SONIC TECHNIQUE AND SYSTEM FOR FACILITATING THE EXTRACTION OF MINERAL MATERIAL

This invention relates to a technique and system employing liquid injection to facilitate the in situ extraction of oil and other minerals such as metalurgical ores by washing, and more particularly to such a technique and system employing sonic energy coupled to water injection and extraction casings and a series of pilings installed in the formation between these casings to facilitate the extraction process.

In the extraction of heavy oil, particularly at shallow depths and situations where the oil is mixed with loose or semi-consolidated sand, as well as in the secondary recovery of oil from older wells, the use of water which is pumped into a second casing proximate to the oil extraction casing is often employed in the extraction process. This second casing is driven into the oil bearing formation at a location proximate to the oil extraction casing such that the pressurized water stream fed into the formation "washes" the oil from the sand, with the oil and water effluent then being extracted by pumping action at the extraction casing. Such prior art techniques have been found to have relatively low efficiency and are relatively costly in view of the great quantities of water needed in their implementation. Further, with such prior art techniques, it is generally not possible to extract more than a fraction of the total oil present in the formation.

The technique and apparatus of the present invention provides means for greatly increasing the efficiency of the extraction of oil by "washing" techniques such that less water is required for a given amount of oil extraction and a greater percentage of the oil in the formation can be removed.

The improvement is achieved in the present invention by sinking a series of pile members with a predetermined initial orientation arranged in a predetermined array between the two casing members which are respectively employed for pumping water into the formation and extracting the oil-water effluent therefrom. These piling members, which may be in the form of corrugated sheets or may be tubular, are sonically driven into the ground so that they penetrate into the oil bearing formation. Then, while water is being pumped into the formation through the water pumping casing, both casings and the pile members are simultaneously sonically driven such as to set up resonant standing wave vibration in the casings and each of these members. The sonic energy effectively loosens the oil from the sand along the path defined by the pilings and the casings such that it can be efficiently drawn into the effluent extraction casing by its pumping action. After most or all of the oil has been extracted from an initial path established by the pilings, the pilings may be removed and installed in a new path which may have a different orientation than the first and the process repeated with successive orientations of the pilings and repetition of the process being employed to extract as much of the oil in the formation as is feasible. In certain situations the pilings are drawn upwardly a short distance after their initial installations so as to form open slots in the earthen formation, this to facilitate the flow of the oil.

It is therefore an object of this invention to provide means employing sonic energy to facilitate the extraction of oil where water washing is employed in the extraction process.

It is a further object of this invention to provide sonic means for facilitating the mining of heavy oil.

It is a further object of this invention to provide an improved sonic system for the secondary extraction of oil with liquid washing.

Other objects of this invention will become apparent upon consideration of the following description taken in connection with the accompanying drawings of which:

Figure 1:
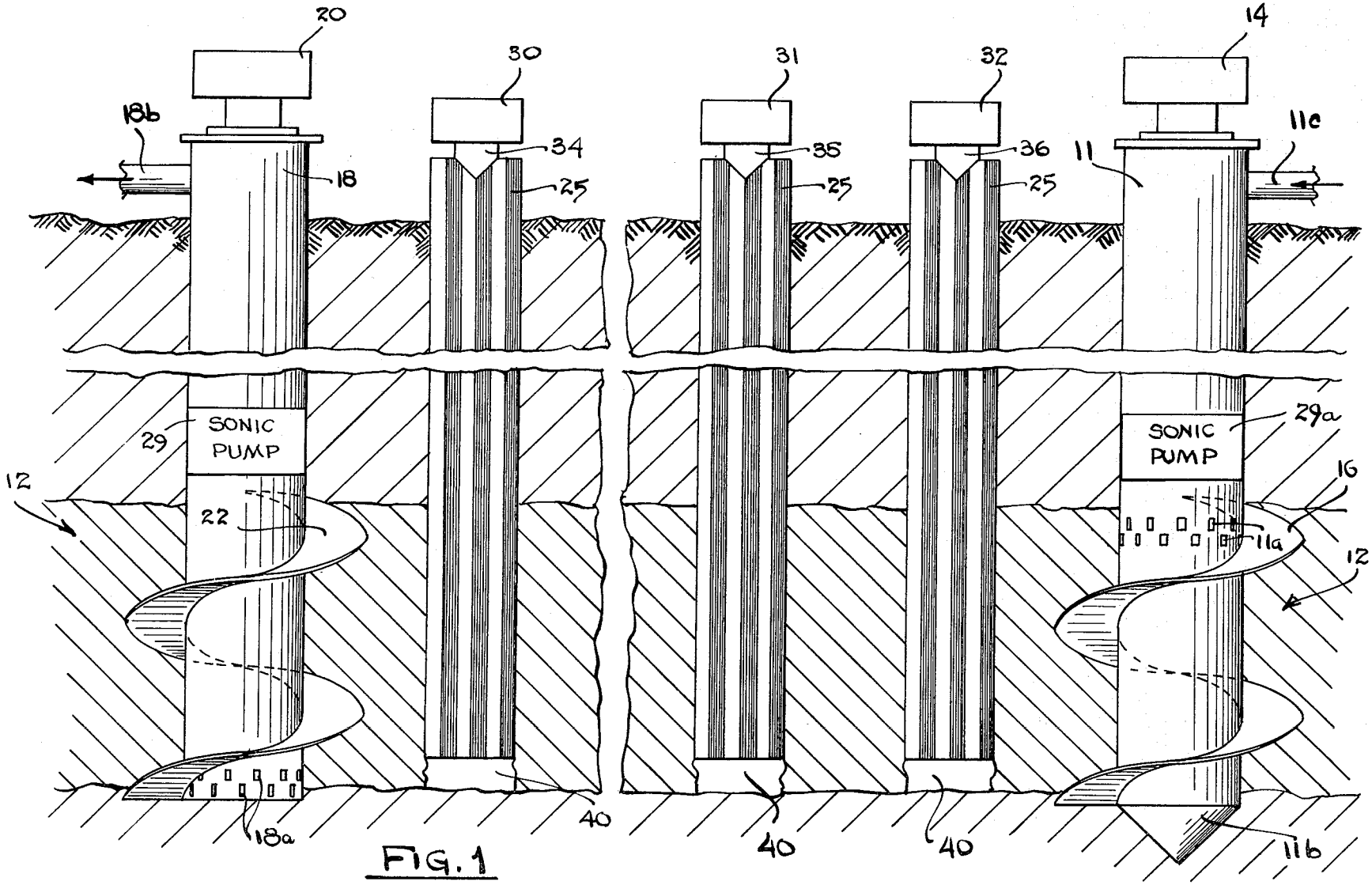
FIG. 1 is a schematic drawing illustrating a preferred implementation of the invention.

It has been found most helpful in analyzing the device of the invention to analogize the acoustically vibrating circuit utilized to an equivalent electrical circuit. This sort of approach to analysis is well known to those skilled in the art and is described, for example, in Chapter 2 of "Sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance $C_e$, mass M is equated with electrical inductance L, mechanical resistance (friction) $R_m$ is equated with electrical resistance R, and mechanical impedance $Z_m$ is equated with electrical impedance $Z_e$.

Thus it can be shown that if a member is elastically vibrated by means of an acoustical sinusoidal force $F_O$ sin $\omega t$ ($\omega$ being equal to $2\pi$ times the frequency of vibration), $$Z_m = R_m + j(\omega C_m) = F_O \sin \omega t / tu \quad (1)$$

Where $\omega M$ is equal to $1/\omega C_m$, a resonant condition exists, and the effective mechanical impedance $Z_m$ is equal to the mechanical resistance $R_m$, the reactive components $\omega M$ and $1/\omega C_m$ cancelling each other out. Under such a resonant condition, velocity of vibration u is at a maximum, power factor is unity, and energy is more efficiently delivered to a load to which the resonant system may be coupled.

It is important to note the significance of the attainment of high acoustical "Q" in the resonant system being driven, to increase the efficiency of the vibration thereof and to provide a maximum amount of power. As for an equivalent electrical circuit, the "Q" of an acoustically vibrating system is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating system can be maximized to make for highly efficient high amplitude vibration by minimizing the effect of friction in the system and/or maximizing the effect of mass in such system.

In considering the significance of the parameters described in connection with Equation (1), it should be kept in mind that the total effective resistance, mass and compliance in the acoustically vibrating system are represented in the equation and that these parameters may be distributed throughout the system rather than being lumped in any one component or portion thereof.

It is also to be noted that orbiting mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristics of Applicant's unique orbiting mass oscillators. Furthermore, in this connection the orbiting mass oscillator automatically changes not only its frequency but its phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

Figures 2, 3, 4:
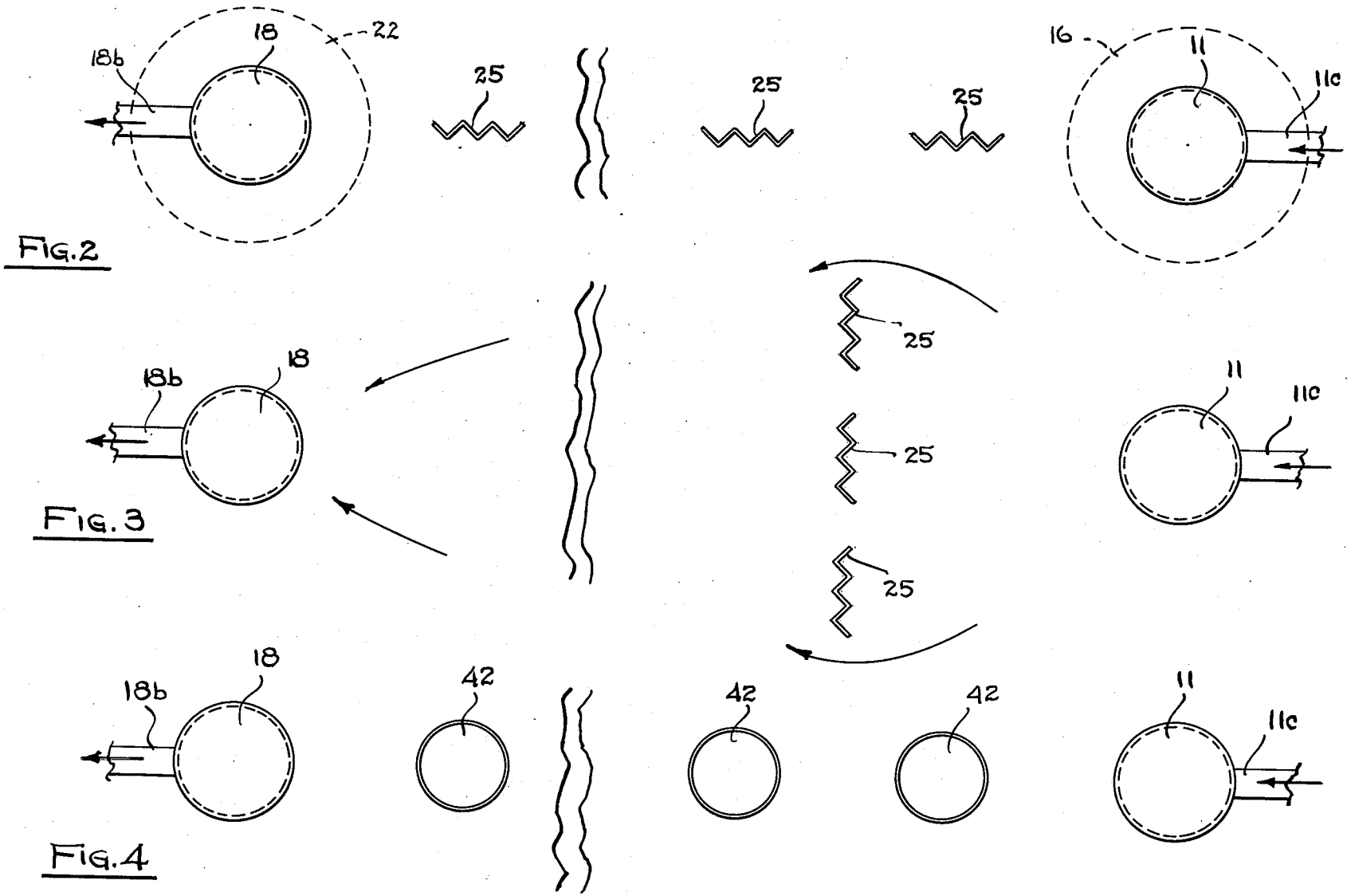
FIG. 2 is a top plan view of the preferred implementation.
FIG. 3 is a top plan view of the preferred implementation illustrating the pilings in a different orientation than in the previous illustration.
FIG. 4 is a top plan view illustrating an implementation of the invention in which tubular pilings, rather than corrugated ones, are employed.

Referring now to FIGS. 1 and 2, a preferred embodiment of the invention is schematically illustrated. Casing member 11 is driven into the earth so that it penetrates oil bearing formation 12 by means of sonic drive 14. The sonic drive may comprise, for example, a sonic drive unit such as described in my U.S. Pat. No. 3,684,037, issued Aug. 15, 1972, the drive system being operated at a frequency such as to set up standing wave resonant vibration of casing 11 (typically of the order of 100 Hertz). Casing 11 is lodged in formation 12 by means of flutes 16. Water is pumped through casing 11 into the formation 12 through apertures 11*a* formed in the walls of the casing, the bottom end of the casing being sealed off by conical end wall portion 11*b*.

Casing 18 is similarly driven into formation 12 by means of sonic drive 20, which is similar to sonic drive 14; the flutes 22 on the bottom of the casing lodging the casing in the formation. The bottom end of casing 18 has a plurality of apertures 18*a* formed in the wall thereof from where oil can be drawn into the interior of the casing.

A series of corrugated piling members 25 initially oriented, as indicated in FIGS. 1 and 2 in a linear array between casings 11 and 18, are driven into the ground so that they penetrate into the formation. Such driving action is accomplished by sonic drives 30–32 which are similar to drives 14 and 20. Drives 30–32 may be coupled to the top ends of the pilings by means of clamping fixtures 34–36, respectively, which may be conventional pile driver clamps. As for the two casings, the piles are driven by their respective sonic drives at frequencies such as to set up elastic standing wave vibration therein.

When the pilings are in place, water is pumped through inlet 11*c* into casing 11 and forced out through apertures 11*a* into formation 12; at the same time, pumping action is initiated in casing 18 to commence drawing fluid in the form of an oil-water effluent through apertures 18*a* up through the casing and out through outlet 18*b*. A sonic pump 29, such as described in my U.S. Pat. No. 3,303,782, issued Feb. 14, 1967, may be employed for pumping the effluent through casing 18 and a similar such pump 29*a* may be employed for pumping water to the formation through casing 11, with the valving for this mast-mentioned pump being reversed to reverse the direction of the pumping action. The sonic pumps tend to radiate sonic energy into the formation. On the other hand, if so desired, conventional pumps may be employed for both pumping functions.

While the pumping action is being accomplished, the sonic drive is simultaneously applied to both casings 11 and 18 and all of the pile members 25 to cause resonant standing wave vibration thereof so as to facilitate the flow of oil. The pile members may be withdrawn upwardly from their initially seated position in the formation to form slots 40 in the formation. The spacing between each of the pile members and between the end pile members and the casings typically may be of the order of two feet, but may be closer or further apart, as particular applications requirements may dictate.

After it appears that all of the oil has feasibly been extracted from the formation with the pile members in their initial positions, the pile members are removed from the formation and reoriented to new positions such as, for example, an in-line orientation normal to the initial line of installation as shown in FIG. 3. The process is then repeated as just described in this new position until it appears that no further oil can be extracted. Then the pilings are again removed and reinstalled in a new orientation, with the process again being repeated. Such reorientations of the pilings and repetition of the process is continued until it appears that no further oil extraction can be accomplished. In this manner, the entire area in the region between the two casings is worked to the optimum extraction of oil therefrom.

While optimum extraction can be achieved with continuous resonant sonic excitation of both casings and pilings, intermittent excitation may be employed in certain situations. It is to be noted that the piling members are oriented with a geometry so as to provide a diversion of the liquid flow in the formation whereby the breadth of the sweep of the water flow and the consequent volume of the oil driven by the water flow through the extraction casing are increased.

Referring now to FIG. 4, the use of tubular pilings rather than corrugated sheet pilings is illustrated, the process and implementation of the invention being the same as that described as for the sheet pilings. If so desired, pilings of various other shapes may also be employed, a significant consideration in the choice of pilings being the availability and economy of such piling structures. Along these lines, sucker rods which are generally available at oil well installations may also be used for the piling members.

It is to be further noted that in the operation of the invention the sonic vibratory energy is to a great measure carried by the water and oil flow in view of the fact that the impedance of the liquid is significantly lower than that of the non-oil bearing material, such that the sonic energy which is carried by the liquid effects refraction and grazing incidence against the formation to efficiently dislodge the oil particles therefrom.

While the invention has been described and illustrated in detail, it is to be clearly understood that this is intended by way of illustration and example only and is not to be taken by way of limitation, the spirit and scope of this invention being limited only by the terms of the following claims.

I claim:

1. A sonic method for facilitating the extraction of mineral from an earthen formation comprising the steps of driving a first casing into said formation, driving a second casing into said formation spaced from said first casing by a predetermined distance, driving a plurality of piling members into said formation between said casings, said pilings being arranged in a predetermined linear array running in a line from one of said casing to the other and having a predetermined spacing between each other and the casings, pumping water into one of said casings whereby the water passes from the bottom portion of the casing into the formation, pumping effluent out of said formation through the other of said casings, while water is being pumped into one of said casings and effluent out the other, sonically vibrating said casings and said piling members at a frequency such as to set up resonant standing wave vibration of said casings and said piling members, the sonic energy loosening the mineral from the earthen material along the path defined by the piling members and the casings such that the mineral can be drawn into the other of said casings, after it appears that all of the effluent has been pumped from the formation, withdrawing the piling members from the formation and reinstalling them in a different array between the two casings and then sonically driving said piling members and said casings and pumping water in and effluent out as before.

2. The method of claim 1 wherein the piling members are corrugated sheets.

3. The method of claim 1 wherein said piling members are arranged in a linear array running in a line from one of said casings to the other.

4. The method of claim 3 wherein the spacing between said piling members and the ends of said array and each of said casings is of the order of two feet.

5. The method of claim 1 wherein said piling members are arranged in a linear array running substantially normal to an axis running between said casings.

6. The method of claim 1 wherein said piling members are tubular.

7. The method of claim 1 and additionally including the additional steps of repeatly removing and reinstalling said pilings into a succession of different arrays between said casings and sonically vibrating the piling members and the casings in a resonant standing wave mode with the pilings in each of said arrays until substantially all of the effluent has been pumped out.

8. The method of claim 1 wherein the casings and piling members are driven into the formation by means of sonic energy applied to said members and said casings to cause resonant standing wave vibration thereof.

9. The method of claim 1 wherein the water is pumped through at least one of said casings by means of a sonic pump which provides additional sonic energy to said formation.

10. A sonic method for facilitating the extraction of mineral from an earthen formation comprising the steps of driving a first casing into said formation, driving a second casing into said formation spaced from said first casing by a predetermined distance, driving a plurality of piling members into said formation between said casings, said pilings being arranged in a predetermined array and having a predetermined spacing between each other and the casings, withdrawing said piling members a short distance upwardly after they are driven into the formation, thereby forming a slot beneath each piling member for facilitating the flow of mineral, pumping water into one of said casings whereby the water passes from the bottom portion of the casing into the formation, pumping effluent out of said formation through the other of said casings, while water is being pumped into one of said casings and effluent out the other, sonically vibrating said casings and said piling members at a frequency such as to set up resonant standing wave vibration of said casings and said piling members, whereby the sonic energy loosens the mineral from the earthen material along the path defined by the piling members and the casings such that the mineral can be drawn into the other of said casings.

11. A system for facilitating the extraction of mineral from a mineral bearing formation, said system including first and second casings driven into said formation in spaced relationship from each other, water being pumped through one of said casings into said formation and effluent being pumped out of the other of said casings, the improvement being means for facilitating the extraction of water-mineral effluent from said formation comprising a plurality of piling members in the form of corrugated sheets driven into said formation between said casings and arranged in a predetermined array and with a predetermined spacing and means for sonically driving both of said casings and said piling members at a resonant standing wave frequency.

12. The system of claim 11 and further including slots formed below the bottom ends of each of said sheets.

* * * * *